US006273188B1

(12) United States Patent
McCafferty et al.

(10) Patent No.: US 6,273,188 B1
(45) Date of Patent: Aug. 14, 2001

(54) TRAILER MOUNTED COILED TUBING RIG

(75) Inventors: Terry L. McCafferty, Sugar Land; Joseph K. Flowers, Houston, both of TX (US); Matthew E. Wilson, Eureka, KS (US); Rod W. Shampine, Houston; Larry D. Welch, Missouri City, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/454,465

(22) Filed: Dec. 3, 1999

Related U.S. Application Data

(60) Provisional application No. 60/111,845, filed on Dec. 11, 1998.

(51) Int. Cl.[7] ..... E21B 19/22

(52) U.S. Cl. ..... 166/77.2; 166/85.5; 242/397.2; 242/403; 280/656; 280/789

(58) Field of Search ..... 166/77.1, 77.2, 166/85.5, 384; 242/397.2, 403, 557, 598; 280/656, 789

(56) References Cited

U.S. PATENT DOCUMENTS

| | | | | |
|---|---|---|---|---|
| 3,658,270 | * | 4/1972 | Slator et al. | 166/77.2 X |
| 4,249,600 | * | 2/1981 | Bailey | 166/77.2 |
| 4,553,590 | * | 11/1985 | Phillips | 166/53 |
| 4,673,035 | * | 6/1987 | Gipson | 166/85.5 X |
| 4,945,938 | * | 8/1990 | Ponsford et al. | 242/470 X |
| 5,660,235 | * | 8/1997 | Sola | 166/384 |
| 5,765,643 | | 6/1998 | Shaaban et al. | 166/384 |
| 5,839,514 | | 11/1998 | Gipson | 166/384 |
| 5,937,943 | | 8/1999 | Butler | 166/77.2 |
| 6,003,598 | | 12/1999 | Andreychuk | 166/76.1 |

* cited by examiner

*Primary Examiner*—George Suchfield
(74) *Attorney, Agent, or Firm*—Robin C. Nava; Thomas O. Mitchell; Stephen Schlather

(57) ABSTRACT

A trailer (10) has a dropped center section (12) defining a well (16) for a coiled tubing reel (22). A mast (30) has a pair of posts (34) on which a carriage (32) is mounted for movement along posts (34). An injector head (36) is supported on carriage (32) for pivotal movement in a vertical plane relative to mast (30) and for horizontal movement along a tubular support member (38) of carriage (32) relative to mast (30). Mast (30) is pivotally mounted on the rear end of trailer (10) for movement away from trailer (10) for positioning over a wellhead. In a stored position, mast posts (34) fit alongside the ends of reel (22) so that to the total height of the stored coiled tubing rig is no more than 13½ feet for over the road travel.

21 Claims, 3 Drawing Sheets

TRAILER MOUNTED COILED TUBING RIG

REFERENCE TO RELATED PROVISIONAL APPLICATION

This application claims the benefit of provisional application Ser. No. 60/111,845 filed Dec. 11, 1998 and entitled "Trailer Mounted Coiled Tubing Rig".

FIELD OF THE INVENTION

This invention relates to coiled tubing for injection and removal from a well bore, and more particularly to a trailer mounted coiled tubing unit or rig. The coiled tubing unit includes a coiled tubing reel, gooseneck, and injector mounted on a mast for movement between an upright operable position and a stored position on the trailer for transport without removal of the elements of the coiled tubing unit.

BACKGROUND OF THE INVENTION

Heretofore, coiled tubing has been wound on a reel and pushed into a bore hole by an injector head after the coiled tubing has traveled over a gooseneck between the reel and the injector head. The injector head is normally suspended from the end of a boom which may be extended or retracted and movable in a horizontal direction such as shown in U.S. Pat. No. 5,411,081 dated May 2, 1995. In some instances, the injector head has been mounted for vertical movement along a mast. However, the injector head and mast have not been easily stored for transport at a minimum height on a transport platform, such as a trailer.

For an over the road vehicle such as a trailer, a maximum height of about 13½ feet cannot be exceeded and be within existing height limitations. Thus, in some instances, the separate elements of a coiled tubing unit are separated after being utilized in a downhole operation for storage and transport to another site. In some instances, more than one trailer may be utilized in the transport of certain elements of the coiled tubing unit. A typical coiled tubing unit for a trailer includes a coiled tubing reel, a gooseneck, an injector head, and a foldable mast mounted on the trailer. Coiled tubing reels are provided with different diameters depending primarily on the length and size of coiled tubing wound on the reel and a trailer should be capable of carrying coiled tubing reels of various diameters. Heretofore, the coiled tubing reels have normally been mounted on the upper surface of a trailer deck or platform for transport. The mast is normally carried by the trailer at a location above the reel.

It is an object of this invention to provide a trailer mounted coiled tubing rig or unit which in a stored position for over the road transport has a minimal height for meeting existing height limitation for over the road travel.

It is another object of the present invention to provide a trailer mounted coiled tubing rig or unit which is foldable between an upright operating position and a retracted stored position for over the road transport without the removal of elements of the coiled tubing rig.

Another object is to provide such a trailer having a well between front and rear wheels of the trailer to receive a coiled tubing reel.

SUMMARY OF THE INVENTION

A trailer mounted coiled tubing unit or rig typically consists of a coiled tubing reel, an injector head, a gooseneck for directing the coiled tubing between the tubing reel and an injector head, and a mast on which the injector head is mounted. The trailer of the present invention is particularly designed for mounting of the coiled tubing unit or rig in a stored position for transport by the trailer at a height under 13½ feet. The rig is easily moved from the transport position to an upright position for injecting and removing coiled tubing from a borehole. The compact coiled tubing unit is moved in a minimum of time between an operable upright position and an inoperable stored position without the removal of any elements of coiled tubing unit.

The specially designed trailer has a pair of parallel side frames or webs extending the length of the trailer and including a dropped center section between front and rear wheels of the trailer defining a well extending substantially below the upper surface of the wheels supporting the trailer. A generally vertical strut or support extends upwardly from each side frame at the well and the coiled tubing reel is mounted for rotation within the well on the struts.

The mast includes a pair of parallel posts connected by cross members and mounted for pivotal movement adjacent an end of the trailer. A trolley or carriage is mounted on the posts for movement along the posts and the injector head is pivotally carried by a horizontal support extending between the carriage members on the posts. The injector head is hinged to the carriage members for pivotal movement about a horizontal axis and is movable horizontally along the horizontal support between the carriage members. The gooseneck also has a pair of hinges for pivoting of gooseneck sections. For movement to a stored position, the carriage members carrying the injector head are moved to a lowered portion along the posts and the posts are folded downwardly onto the side frames of the trailer alongside the ends of the coiled tubing reel with the injector head adjacent the reel. The upper surface of the injector head and the upper surface of a levelwind mechanism for winding of the coiled tubing onto the reel project slightly above the upper surface of the reel to define the uppermost surfaces for a compact stored coiled tubing unit of a height above the roadway surface less than 13½ feet without the removal of any elements of the unitized coiled tubing unit.

Application Ser. No. 09/409,113 relating to a levelwind mechanism for winding of coiled tubing is incorporated in its entirety herein by reference.

BRIEF DESCRIPTION OF THE INVENTION

Figure 4:
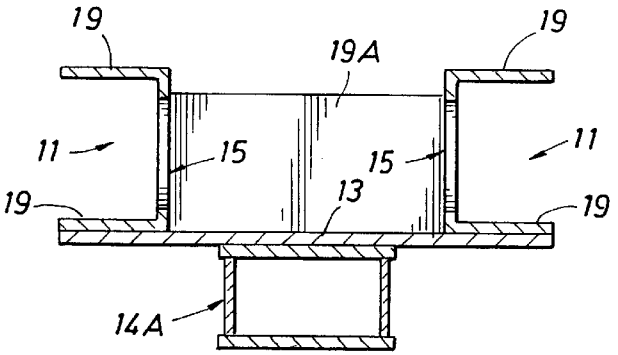
FIG. 4 is a section taken generally along line 4—4 of FIG. 1.

As shown in the drawings, and particularly FIGS. 1–5, trailer 10 has a pair of side frames 11 extending the length of trailer 10 and a lower deck or floor 13 extending between side frames 11. Trailer 10 includes a front end section 10A, a rear end section 10B, and a dropped center section 10C between end sections 10A and 10B. Side frames 11 include sill members 15 having horizontal upper and lower flanges 19. Dropped center section 12 extends below the upper surface of the trailer wheels as shown at 14 to form a well 16. A chassis 14A as shown in FIG. 4 supports wheels 14. Vertical struts 18 extend upwardly from well 16 and are connected between upper and lower flanges 19 which are reinforced. Transverse stiffeners 19A extend between side frames 11 at opposed ends of well 16. Upper flanges 19 have upwardly tapering front surfaces and downwardly tapering rear surfaces relative to the front of trailer 10 to provide a streamlined shape and appearance and to reduce the weight of the rig. As shown in plan in FIG. 2, the front end portions of sill members 15 are tapered outwardly in a horizontal direction at 21 from the front end of trailer 10. Lower flanges 19 extend in a horizontal direction for end sections 10A and 10B and for the bottom of center section 10C. Front end section 10A tapers upwardly from the front end of trailer 10 to center section 10C. Rear end section 10B tapers downwardly from center section 10C to the rear end of trailer 10.

Figure 2:
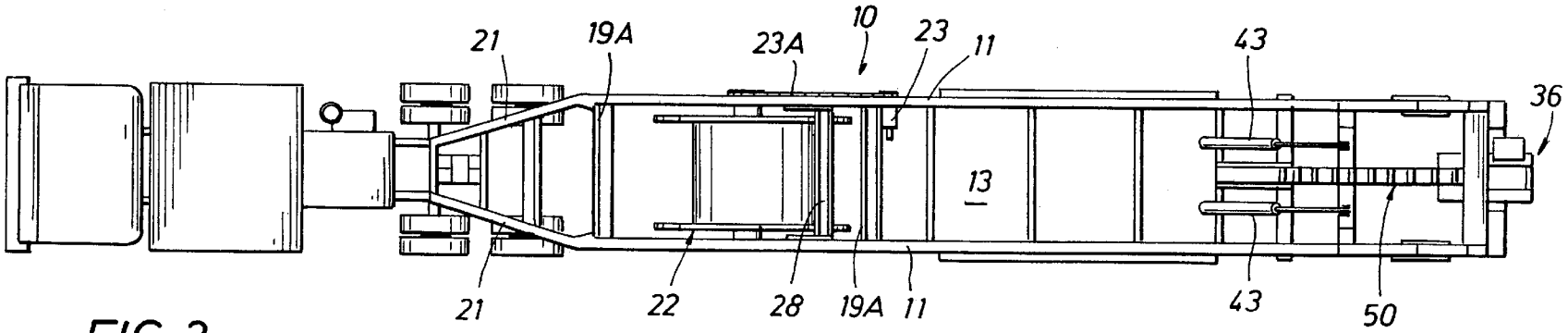
FIG. 2 is a top plan of the coiled tubing rig shown in FIG. 1 including the tractor for providing power to the rig and for over the road transport.

A coiled tubing reel 22 is supported on struts 18 for rotation and is received within the well 16 for projecting a minimal height above the roadway surface. Bearings 24 on struts 18 support reel 22 for rotation. A hydraulic motor 23 is connected by sprockets and a sprocket chain 23A for rotating reel 22 as shown in FIG. 2. A levelwind track 26 has a guide 28 to receive coiled tubing C for guiding coiled tubing C onto reel 22 for reeling and unreeling. Track 26 is pivotally mounted at 29 on a support 29A. In a stored position, track 26 may be pivoted downwardly.

Figure 5:
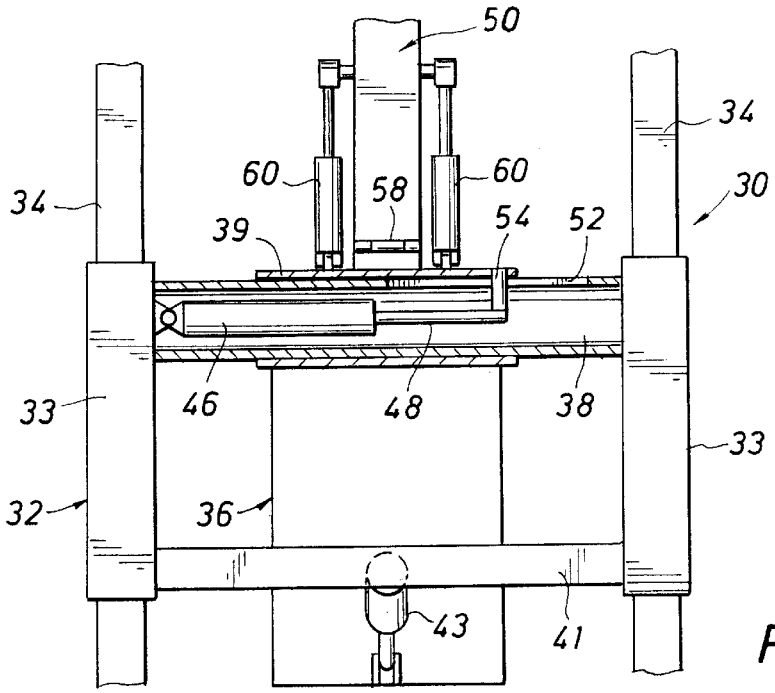
FIG. 5 is an elevational view largely schematic of the hydraulic cylinder arrangement for movement of an injector head laterally and for movement of the gooseneck to a stored position.

A mast generally indicated at 30 includes a pair of parallel posts 34 pivotally mounted at 34A on the rear end of trailer 10 and a trolley or carriage 32 includes a carriage member 33 mounted on each post 34 and having rollers for movement along posts 34. An upper horizontal tubular support 38 is secured between carriage members 33. An injector head 36 has a sleeve 39 mounted on tubular support 38 for pivoting in a vertical plane about tubular support 38. A lower horizontal supporting brace 41 is also secured between carriage members 33 and a hydraulic cylinder 43 is secured between brace 41 and injector head 36 to pivot injector head 36 in a vertical plane about tubular member 38 relative to mast 30 as shown in FIG. 5. Injector head 36 is movable along tubular support 38 in a horizontal direction by a fluid cylinder 46 secured within tubular member 38 and having a piston rod 47 with an end tab 54 thereon received within a slot 52 in the tubular member 38. Tab 54 is secured to sleeve 39 and is effective to move injector head 36 horizontally along tubular member 38 when cylinder 46 is actuated. A gooseneck 50 has a hinge 58 mounted on injector head 36 to permit folding of gooseneck 50 for storage and transport. A pair of cylinders 60 mounted on sleeve 39 of injector head 36 extend to gooseneck 50 for folding of gooseneck 50 about hinge 58 in a stored position on trailer 10. A pair of hydraulic cylinders 62 mounted between deck 13 and mast 30 pivot mast 30 and injector head 36 about pivot 34A between operable and stored positions as shown respectively in FIGS. 1 and 3.

Figure 3:
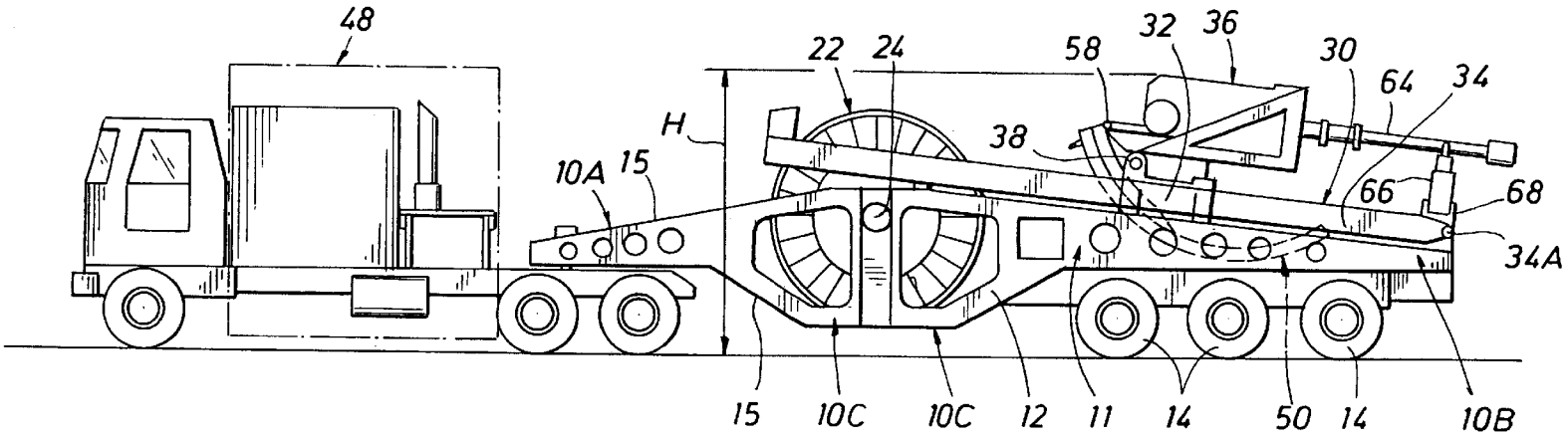
FIG. 3 is a side elevation showing a tractor mounted coiled tubing unit in a retracted storage position for transport.
Figure 6:
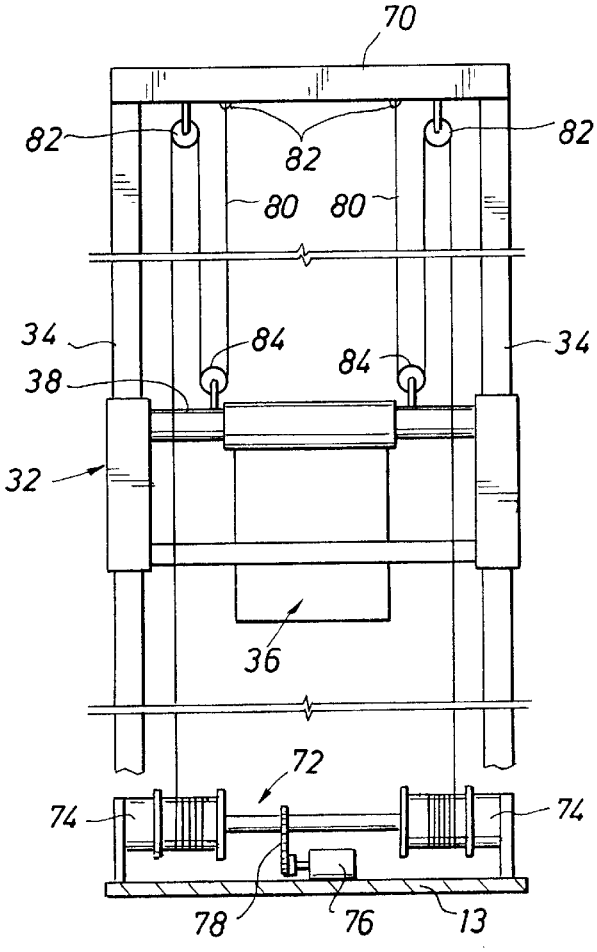
FIG. 6 is an elevational view, partly schematic, of the winch arrangement for movement of the injector head along the mast.

A tubular member 64 extends downwardly from injector head 36 and is adapted for connection to a wellhead W. A support 66 pivotally connected at 68 to a mast post 34 is adapted to support tubular member 64 in stored position as shown in FIG. 3. For movement of carriage 32 and injector head 36 along mast posts 34, reference is made to FIG. 6. An upper beam 70 is secured between mast posts 34. A winch 72 has a pair of drums 74 driven by a motor 76 and suitable gears 78. A cable 80 from each drum 74 extends about pulley 82 on beam 70 and about pulley 84 on carriage 32. The end of cable 80 is anchored at 86 to beam 70. Actuation of winch 72 for winding of cables 80 results in raising carriage 32. Actuation of winch 72 for unwinding of cable 80 results in the lowering of carriage 32 from the weight of injector head 36.

Figure 1:
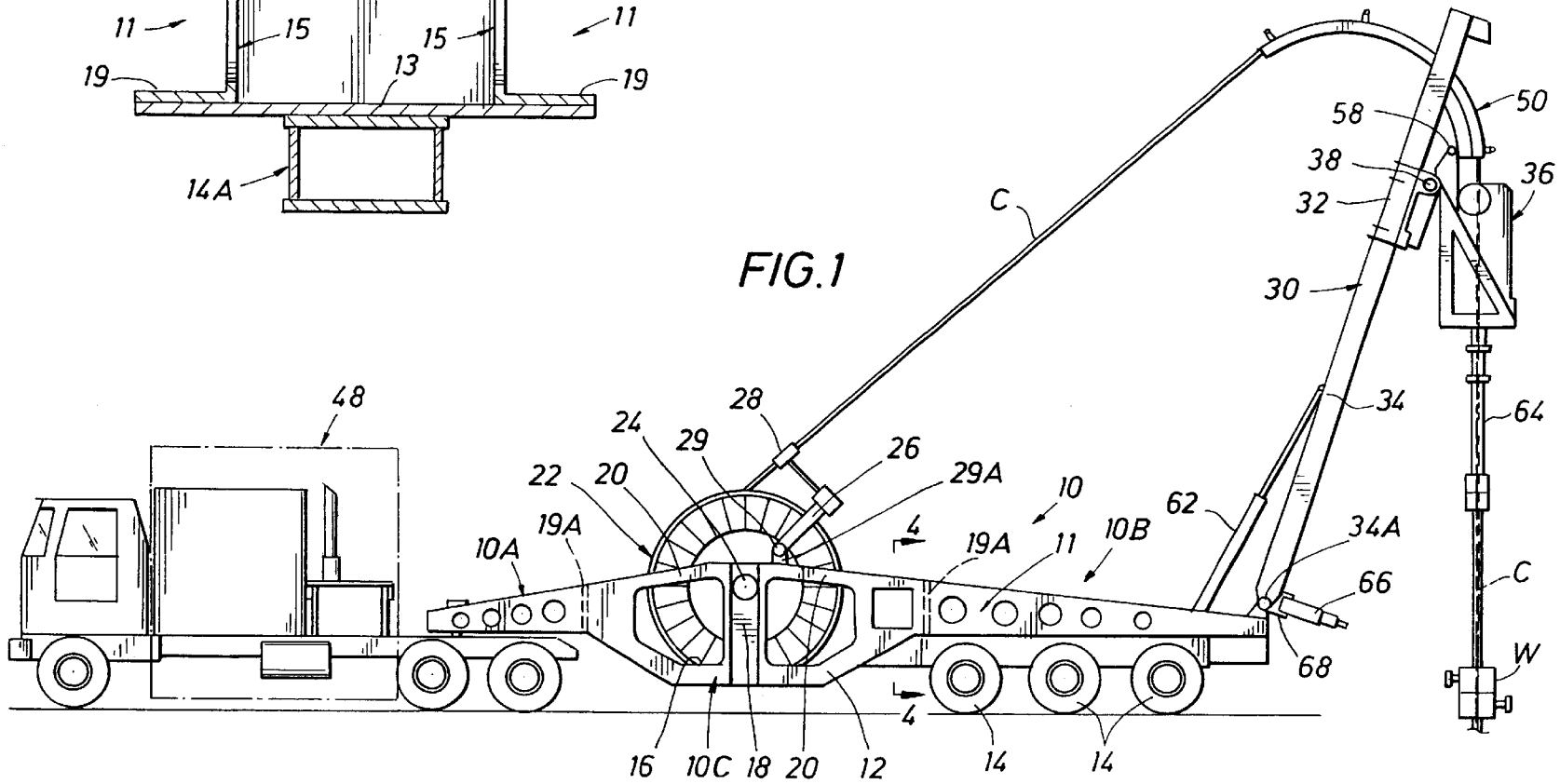
FIG. 1 is a side elevation of a coiled tubing unit or rig mounted on a trailer connected to a tractor and showing the rig in an upright operable position for injecting or removing coiled tubing from a borehole.

For movement of mast 30 from the operable position shown in FIG. 1 to the stored position shown in FIG. 3, injector head 36 is lowered by winch 72 along mast 30 to a position for fitting adjacent reel 22. Gooseneck 50 is folded by cylinders 60 about pivot 58 to a position beneath injector head 36. Mast 30 is then folded by cylinders 62 downwardly alongside the ends of reel 22 onto the tapered upper surface of upper flanges 19 which support mast 30 thereon. Tubular member 64 is supported by support 66.

The maximum height H of the stored coiled tubing unit is 13½ feet from the roadway surface with mast posts 34 supported on the upper surfaces of upper flanges 19 of side frames 11 and fitting alongside the ends of coiled tubing reel 22 as shown in FIG. 3. In this position, injector head 36 projects a minimal distance above coiled tubing reel 22 and levelwind track 26 likewise projects a minimal distance above coiled tubing reel 22 so that the maximum height of the coiled tubing unit on trailer 10 is less than 13½ feet thereby to provide a compact unit in a stored position for transport by a tractor 48 from one site to another site. Tractor 48 has suitable power units powering the coiled tubing unit or rig 10.

From the above, a tractor mounted coiled tubing rig or unit has been illustrated which may be folded from an upright operable position to a retracted storage position for transport in a minimum of time and with a projected height above the roadway less than 13½ feet which is the maximum height permitted by regulations for over the road travel in many locations. None of the elements of the coiled tubing unit or rig are required to be separated or removed from the rig for transport. The coiled tubing reel 22 is easily supported within well 16 formed by dropped center section 12 of trailer 10 while mast 30 is folded along opposed ends of reel 22 to permit such a compact low height reel 22 to be utilized.

Important features of the invention include mast 30 having a pair of parallel mast posts 34 pivotally mounted adjacent the rear end of trailer 10 with injector 36 mounted on carriage 32 for movement along posts 34. Posts 34 are foldable to a stored retracted position alongside the ends of the coiled tubing reel 22 and supported on tapered upper flanges 19. Injector 36 is mounted for horizontal movement relative to carriage 32 and for pivotal movement in a vertical plane relative to carriage 32 thereby to position injector 36 accurately relative to a wellhead receiving the coiled tubing C.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. In combination;

a roadway trailer having a pair of spaced generally parallel side frames and a floor secured between said side frames;

a coiled tubing rig mounted on struts on said trailer for movement between an operable position for the injection of coiled tubing in a borehole and an inoperable stored position for transport; said coiled tubing rig including a coiled tubing reel mounted on said trailer for rotation of said reel and having a pair of opposed spaced end flanges for retaining the coiled tubing on the reel, a mast mounted for pivotal movement on a rear end of said trailer and having a pair of spaced longitudinally extending parallel mast posts, and an injector mounted on said mast for injecting coiled tubing in the borehole;

said mast posts being spaced from each other a distance greater than the length of said coiled tubing reel between said end flanges, said mast posts when moved to stored position on said trailer fitting alongside said end flanges and receiving said reel therebetween thereby to minimize the projecting height of said mast on said trailer when in stored position;

mounting means adjacent a rear end of said trailer mounting said mast for pivotal movement;

each of said side frames having a rear end section including upper surfaces inclined upwardly from said rear end, said mast posts when moved to a stored position being supported on said upper surfaces.

2. In combination;

a roadway trailer having a pair of spaced generally parallel side frames and a floor secured between said side frames;

a coiled tubing rig mounted on struts on said trailer for movement between an operable position for the injection of coiled tubing in a borehole and an inoperable stored position for transport; said coiled tubing rig including a coiled tubing reel mounted on said trailer for rotation of said reel and having a pair of opposed spaced end flanges for retaining the coiled tubing on the reel, a mast mounted for pivotal movement on a rear end of said trailer and having a pair of spaced longitudinally extending parallel mast posts, and an injector mounted on said mast for injecting coiled tubing in the borehole;

said mast posts being spaced from each other a distance greater than the length of said coiled tubing reel between said end flanges, said mast posts when moved to stored position on said trailer fitting alongside said end flanges and receiving said reel therebetween thereby to minimize the projecting height of said mast on said trailer when in stored position;

a carriage being mounted on said mast for travel along said mast; and means mounting said injector on said carriage for pivotal movement in a vertical plane about a generally horizontal axis.

3. In combination;

a roadway trailer having a pair of spaced generally parallel side frames and a floor secured between said side frames;

a coiled tubing rig mounted on struts on said trailer for movement between an operable position for the injection of coiled tubing in a borehole and an inoperable stored position for transport; said coiled tubing rig including a coiled tubing reel mounted on said trailer for rotation of said reel and having a pair of opposed spaced end flanges for retaining the coiled tubing on the reel, a mast mounted for pivotal movement on a rear end of said trailer and having a pair of spaced longitudinally extending parallel mast posts, and an injector mounted on said mast for injecting coiled tubing in the borehole;

said mast posts being spaced from each other a distance greater than the length of said coiled tubing reel between said end flanges, said mast posts when moved to stored position on said trailer fitting alongside said end flanges and receiving said reel therebetween thereby to minimize the projecting height of said mast on said trailer when in stored position;

a gooseneck being pivotally mounted on said injector for directing the coiled tubing into the injector; and fluid pressure means being operatively connected to said gooseneck to pivot said gooseneck beneath said injector in a stored position on the trailer.

4. The combination as set forth in claim 1 wherein fluid pressure means is operatively connected to said mast for pivotal movement of said mast to a predetermined position.

5. In combination;

a roadway trailer having a pair of spaced generally parallel side frames and a floor secured between said side frames;

a coiled tubing rig mounted on struts on said trailer for movement between an operable position for the injection of coiled tubing in a borehole and an inoperable stored position for transport; said coiled tubing rig including a coiled tubing reel mounted on said trailer for rotation of said reel and having a pair of opposed spaced end flanges for retaining the coiled tubing on the reel, a mast mounted for pivotal movement on a rear end of said trailer and having a pair of spaced longitudinally extending parallel mast posts, and an injector mounted on said mast for injecting coiled tubing in the borehole;

said mast posts being spaced from each other a distance greater than the length of said coiled tubing reel between said end flanges, said mast posts when moved to stored position on said trailer fitting alongside said end flanges and receiving said reel therebetween thereby to minimize the projecting height of said mast on said trailer when in stored position;

wherein a tubular member extends downwardly from said injector for connection to the wellhead, and a support arm adjacent the rear end of said trailer extends outwardly from said mast in the stored position of said rig for supporting said tubular member thereon.

6. The combination as set forth in claim 1 wherein said trailer has a dropped center section between opposed ends of said trailer, and said coiled tubing reel is received within said dropped center section.

7. The combination as set forth in claim 6 wherein rear wheels are mounted on said trailer and said dropped center section defines a well extending below the upper surface of said wheels to permit said coiled tubing reel to project a minimal height above the supporting surface for said trailer.

8. A roadway trailer for over the road transport of a coiled tubing rig between selected sites, the coiled tubing rig being movable between an operable position on the trailer for the injection of coiled tubing and a stored position for transport in which said rig extends from the road no more than 13½ feet said coiled tubing rig including a coiled tubing reel mounted on said trailer for rotation, and a mast having a pair of spaced longitudinally extending parallel mast posts mounted for pivotal movement on a rear end of said trailer;

a carriage mounted on said posts for movement along said posts;

an injector carrying a gooseneck mounted on said carriage for longitudinal movement along said posts; and means mounting said injector and gooseneck thereon for pivotal movement on said carriage about a generally horizontal axis for swinging movement in a vertical plane away from the rear end of said trailer to position said injector over a surface wellhead for injection of the coiled tubing.

9. The roadway trailer as set forth in claim 8;

fluid pressure means operatively connected to said mast for pivotal movement of said mast on the rear end of said trailer to a desired position over a surface wellhead; and fluid pressure means on said carriage operatively connected to said injector for pivotal movement of said injector in a vertical plane relative to said mast.

10. The roadway trailer as set forth in claim 8;

a tubular support mounted on said mast for pivotal movement with said mast;

said injector having a tubular member extending therefrom connected to said wellhead in an operable position and disconnected from said wellhead in an inoperable position, said tubular member in a stored position of said rig supported on said tubular support.

11. The roadway trailer as set forth in claim 8;

said posts being spaced from each other a distance greater than the length of said reel for positioning alongside said reel in the stored position of the rig to receive the reel between the posts.

12. The roadway trailer as set forth in claim 8;

said generally parallel side frames each including an upper flange inclined upwardly from the rear end of said trailer, and said posts are supported on said flanges in the stored position of the rig.

13. A roadway trailer for transporting a coiled tubing rig to a well site and for supporting the coiled tubing rig for a borehole operation, the coiled tubing rig including a coiled tubing reel, an injector for injecting the coiled tubing in the borehole and for removing the coiled tubing from the borehole, and a mast supporting the injector; said trailer comprising:

a pair of parallel side frames having opposed end sections and a dropped center section between said end sections forming a well for the coiled tubing reel between said end frames; said side frames at said dropped center section each including a longitudinally extending upper frame member, a longitudinally extending lower frame member, and a generally vertical post extending between said upper and lower frame members; and reel mounting means supported by said posts mounting said reel for rotation in said well.

14. A roadway trailer as set forth in claim 13 wherein said end sections of each side frame taper downwardly in a vertical plane from said center section to the adjacent end of the trailer.

15. A roadway trailer as set forth in claim 13 wherein each side frame has an upper flange extending the length of the side frame and a spaced lower flange extending the length of the side frame, said lower flange extending in a generally horizontal direction at said end sections and extending downwardly at said center section to define said well.

16. A roadway trailer as shown in claim 15 wherein said end sections define a front end section at the front end of the trailer and a rear end section at the rear end of the trailer, each side frame having an upper flange inclined upwardly from said front end of said trailer to said center section and inclined downwardly from said center section to said rear end of said trailer.

17. A roadway trailer as shown in claim 16 wherein said side frames taper inwardly from said center section to said front end of said trailer.

18. A roadway trailer for transporting a coiled tubing rig to a well site and for supporting the coiled tubing rig for a borehole operation, the coiled tubing rig including a coiled tubing reel, an injector for injecting the coiled tubing in the borehole and for removing the coiled tubing from the borehole, and a mast supporting the injector; said trailer comprising:

a pair of parallel side frames having opposed end sections and a dropped center section between said end sections forming a well for the coiled tubing reel between said end frames; each of said side frame having a continuous upper flange and a continuous lower flange, said upper flange inclined upwardly from the front end of said trailer to said center section and inclined downwardly from said center section to the rear end of said trailer.

19. A roadway trailer as shown in claim 18 wherein said lower flange has a generally horizontal end portion beneath each of said end sections, a generally horizontal center portion at each center section for the bottom of the well defined by said center section; and inclined connecting portions connecting said horizontal center portion with said horizontal end portions.

20. A roadway trailer as set forth in claim 19 wherein each side frame has a vertical post extending between said upper and lower flanges at said dropped center section.

21. A roadway trailer as set forth in claim 20 wherein reel mounting means are mounted on each post to support the coiled tubing reel for rotation to unwrap and wrap said coiled tubing.

* * * * *